US005413849A

United States Patent [19]

Austin et al.

[11] Patent Number: 5,413,849

[45] Date of Patent: May 9, 1995

[54] COMPOSITE ELASTIC NONWOVEN FABRIC

[75] Inventors: Jared A. Austin, Greer; G. Stanley Zimmerman, Jr., Greenville, both of S.C.

[73] Assignee: Fiberweb North America, Inc., Simpsonville, S.C.

[21] Appl. No.: 255,003

[22] Filed: Jun. 7, 1994

[51] Int. Cl.[6] ..... D04H 1/58

[52] U.S. Cl. ..... 428/293; 28/104; 28/105; 428/284; 428/287; 428/288; 428/294; 428/296; 428/297; 428/298; 428/299; 428/326; 428/373; 428/903

[58] Field of Search ..... 428/284, 287, 293, 294, 428/296, 297, 298, 299, 903, 288, 373, 326; 28/104, 105

[56] References Cited

U.S. PATENT DOCUMENTS 4,775,579 10/1988 Hagy et al. ..... 428/299
4,808,467 2/1989 Suskind et al. ..... 428/299
5,219,633 6/1993 Sabee ..... 428/294
5,227,227 7/1993 Boulanger ..... 428/299
5,298,315 3/1994 Fukai et al. ..... 428/299
5,334,446 8/1994 Quantrille et al. ..... 428/299

*Primary Examiner*—James J. Bell
*Attorney, Agent, or Firm*—Bell Seltzer, Park & Gibson

[57] ABSTRACT

The invention provides composite elastic nonwoven fabrics and processes of making the same. The composite elastic fabrics of the invention include a plurality of longitudinally extending elastomeric filaments and at least one fibrous web including staple fibers and anchoring fibers entangled with the elastomeric filaments. The anchoring fibers strengthen the attachment of the staple fibers to the elastomeric filaments, so that the entire fibrous mass extends as a unit when the fabric is extended. The resultant product is a coherent, substantially unitary structure encompassing the elastomeric filaments.

31 Claims, 7 Drawing Sheets

COMPOSITE ELASTIC NONWOVEN FABRIC

FIELD OF THE INVENTION

The invention relates to composite elastic nonwoven fabrics and to processes for producing them. More specifically, the invention relates composite nonwoven fabrics having desirable durability, conformability, and stretch and recovery properties.

BACKGROUND OF THE INVENTION

Elastic fabrics are useful in a variety of applications, including use as a component in bandaging materials, garments, diapers, supportive clothing and personal hygiene products. Incorporating an elastic component into these and other products is desirable because the resultant product can conform to irregular shapes and allow more freedom of body movement than fabrics with limited extensibility.

Elastomeric materials have been incorporated into various fabric structures to provide stretchable fabrics. In many instances, such as where the fabrics are made by knitting or weaving, there is a relatively high cost associated with the fabric. In cases where the fabrics are made using nonwoven technologies, the fabrics can suffer from insufficient strength and only limited durability, stretch and recovery properties.

Elastomers used to fabricate elastic fabrics often have an undesirable rubbery feel. When these materials are used in composite nonwoven fabrics, the hand and texture of the fabric can be perceived by the user as sticky or rubbery and therefore undesirable. The fabric aesthetics can be improved by incorporating synthetic staple fibers, wood pulp, or natural fibers such as cotton into the elastic nonwoven. Care must be taken, however, to combine the elastic filaments with the non-elastic staple fibers so that the entire fibrous mass extends as a unit when the fabric is extended.

Prior procedures have incorporated an elastic net into a nonwoven structure to provide a stretchable nonwoven fabric. For example, U.S. Pat. No. 4,775,579 to Hagy, et al. discloses desirable composite elastic nonwoven fabrics containing staple textile fibers intimately hydroentangled with an elastic web or an elastic net. One or more webs of staple textile fibers and/or wood pulp fibers can be hydroentangled with an elastic net according to the disclosure of this invention. The resulting composite fabric exhibits characteristics comparable to those of knit textile cloth and possesses superior softness and extensibility properties. The rubbery feel traditionally associated with elastomeric materials can be minimized or eliminated in these fabrics.

Despite the advantages provided by these fabrics and techniques, for some converting processes and end use applications, a fabric having one dimensional stretch, i.e., elastic properties in one of either the machine direction or the cross machine direction, is desirable. In addition, the manufacturing processes associated with prior art fabrics can involve complicated and difficult manufacturing steps, increasing the cost of the fabric and/or decreasing the fabric uniformity. Thus it would also be desirable to provide an elastic fabric at a minimum cost.

U.S. Pat. No. No. 3,485,706 to Evans discloses textile-like nonwoven fabrics produced by traversing fibrous material with high energy liquid streams while supported on an apertured member to consolidate the material in a repeating pattern of entangled fiber regions and interconnecting fibers. In Example 56, a bulky, puckered nonwoven fabric is prepared by hydroentangling polyester staple fibers into a stretched warp of spandex yarn. Upon working the thus formed fabric, however, the staple fibers are mechanically detached from the spandex. That is, the fibers are not firmly anchored into the composite web so that following repeated stretch and relaxation, portions of the staple fiber mass do not follow the extension of the elastic filaments, and the fabric becomes nonuniform in appearance and mechanical performance.

SUMMARY OF THE INVENTION

The invention provides composite elastic nonwoven fabrics which are durable and exhibit good strength and elasticity properties. The fabrics can have a high degree of elasticity and stretch recovery while maintaining uniform appearance and mechanical performance. In addition, the fabrics can be produced at lower costs than fabrics produced using other more complicated techniques.

The composite elastic nonwoven fabrics of the invention include a warp of substantially parallel elastomeric filaments. A fibrous web is entangled with the elastomeric filaments to form a unitary composite nonwoven fabric. The elastomeric filaments provide one dimensional elasticity to the composite fabric, while the fibrous web can be selected to provide a variety of features to the composite fabric, such as softness, pleasant hand, and the like. The fibrous web includes both staple fibers and anchoring fibers, described below.

During entanglement, both the staple fibers and the anchoring fibers of the fibrous web are secured to the elastomeric filaments throughout the fabric. The anchoring fibers are provided so that the fibrous web remains secured or attached to the elastomeric filaments when the composite structure is stretched and released. Thus, the coherent structure of the composite elastic nonwoven fabric is maintained, for example, during converting processes and in end use applications. The resultant entangled product is a coherent, substantially unitary fibrous elastic structure that is stretchable, conformable, and yet soft, with increased durability and mechanical stability.

Preferably, the warp of elastomeric filaments and the fibrous web are hydroentangled. As known in the art, in hydroentanglement, high pressure fluid, such as water, is directed through a composite structure such as that described above to hydroentangle the fibers in the webs with each other. As a result of the hydroentangling treatment, at least a portion of the fibers in the fibrous layer extend between and are secured to at least a portion of the elastomeric filaments of the elastomeric web.

Preferably the anchoring fibers are mechanically attached to the elastomeric filaments. This can be achieved, for example, by providing anchoring fibers with a roughen or irregular surface, or a high surface area, for example, wood pulp fibers, meltblown fibers, and thermally activated binder fibers. The addition of such fibers as anchoring fibers increases the surface area of the fibrous web and promotes friction between the staple fibers and the elastomeric filaments. Thus, these fibers increase the strength of the attachment of the staple fibers with the elastomeric filaments by contributing to the mechanical securement of the staple fibers and the elastomeric filaments.

The composite nonwoven elastic fabrics of the invention can be manufactured by relatively simple and straightforward manufacturing processes which involve forming a layered structure including the staple fiber/anchoring fiber-containing fibrous web and the warp of elastomeric filaments and entangling the layered structure. When the anchoring fibers are binder fibers, the composite fabric can be subsequently thermally treated. Entangling (and bonding when required) is preferably accomplished with stretching of the elastic warp to provide a highly elastic and coherent composite fabric.

In preferred embodiments of the invention, separate fibrous webs containing staple and anchoring fibers are disposed on opposite sides of the elastomeric web prior to entangling. This ensures that the elastomeric warp is confined within the interior of the composite fabric and that sufficient textile fibers are provided on each side of the elastomeric web so that the hand and coherent nature of the fabric is improved.

BRIEF DESCRIPTION OF THE DRAWINGS

In the drawings which form a portion of the original disclosure of the invention.

DETAILED DESCRIPTION OF THE INVENTION

In the following detailed description of the invention, specific preferred embodiments of the invention are described to enable a full and complete understanding of the invention. It will be recognized that it is not intended to limit the invention to the particular preferred embodiments described, and although specific terms are employed in describing the invention, such terms are used in the descriptive sense for the purpose of illustration and not for the purpose of limitation. It will be apparent that the invention is susceptible to variation and changes within the spirit of the teachings herein.

Figure 1:
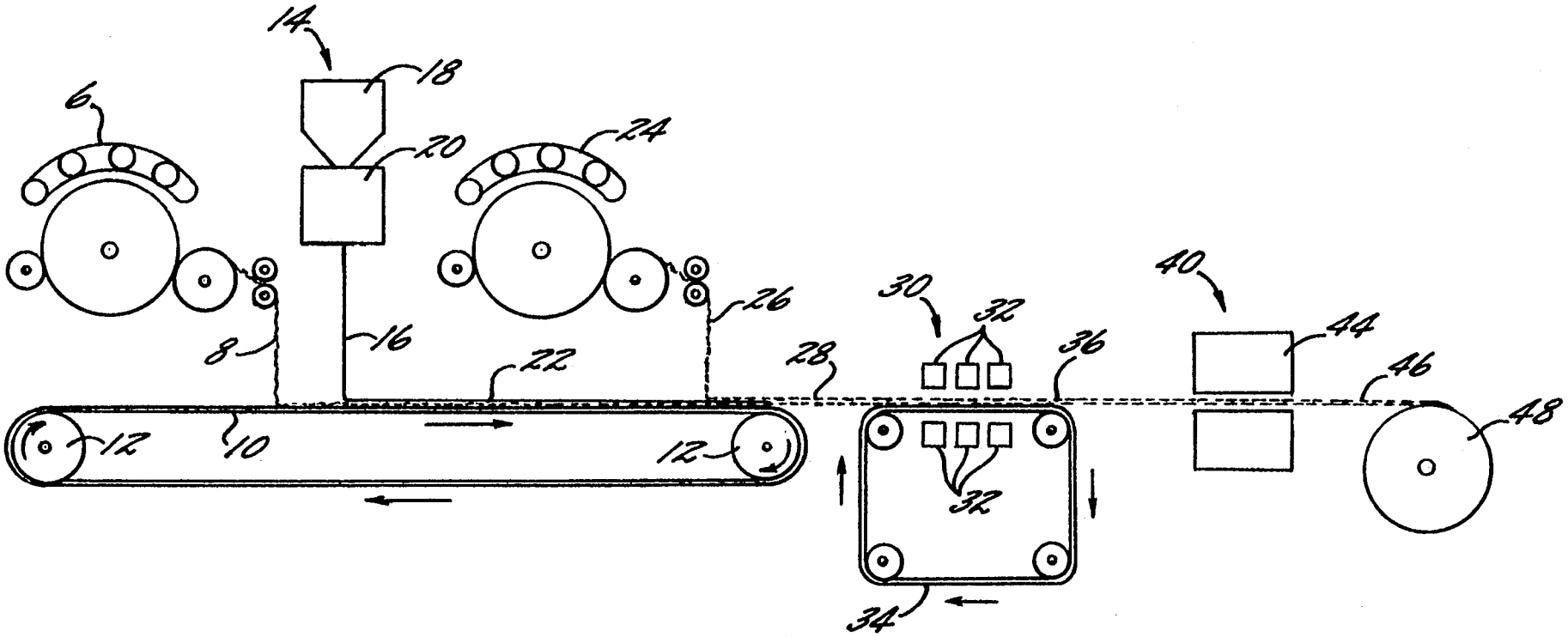
FIG. 1 schematically illustrates one method and apparatus for the manufacture of a composite elastic nonwoven fabric according to the present invention.

FIG. 1 schematically illustrates one process and apparatus for forming the composite nonwoven webs of the invention. A carding apparatus 6 forms a first carded layer 8 onto forming screen 10. Carded fibrous layer 8 includes synthetic or natural staple fibers and anchoring fibers. The anchoring fibers advantageously are present in fibrous web 8 in an amount of between about 10 and 50 percent by weight of the fibrous web 8. Web 8 is moved by forming screen 10 in the longitudinal direction by rolls 12.

A conventional meltspinning apparatus 14 forms a second layer comprising a plurality of substantially continuous elastomeric filaments 16 onto carded layer 8. As will be appreciated by the skilled artisan, the elastomeric polymer to be meltspun is heated in an extruder 18, and the heated polymer is extruded from a spinneret 20 having a plurality of linearly arranged holes or orifices into an array of substantially parallel, polymeric monofilaments. The monofilaments are collected onto the forming screen 10 to form a warp 16, i.e., a plurality of elastomeric strands or filaments longitudinally oriented substantially parallel to one another in the machine direction. Preferably, the longitudinal strands or filaments are provided in an amount such that there are between about 4 and 20 or more strands or filaments per inch. As used herein, the term "elastomeric" refers to nonwoven webs and fabrics capable of substantial recovery, i.e., greater than about 75% recovery, and preferably greater than about 90% recovery, when stretched in an amount of about 10% at room temperature expressed as:

$$\% \text{ recovery} = (L_s - L_r)/(L_s - L_o) \times 100$$

where: $L_s$ represents stretched length; $L_r$ represents recovered length measured one minute after recovery; and $L_o$ represents original length of the material.

As the warp 16 is deposited onto the carded web 8, a two-layer structure 22 is formed and is conveyed by forming screen 10 in the longitudinal direction as indicated in FIG. 1. A second carding apparatus 24 deposits a second carded fibrous layer 26, also preferably comprising staple and anchoring fibers, onto the composite layered structure 22 to thereby form a three-layer composite structure 28 consisting of a carded web/elastomeric warp/carded web. The staple and/or anchoring fibers and other fibers making up carded web 26 can be the same or different as compared to the fibers in carded web 8. The content of anchoring fibers in carded web 26 can also be the same or different as compared to the content of anchoring fibers in carded web 8.

The three-layer composite web 28 is conveyed longitudinally as shown in FIG. 1 to a hydroentangling station 30 wherein a plurality of manifolds 32, each including one or more rows of fine orifices, direct high pressure jets through the composite web 28 to hydroentangle the fibers in the webs 8 and 26 with each other and with the filaments of the elastomeric warp 16. As a result of the hydroentangling treatment, at least a portion of the fibers in each of the carded layer 8 and 26 extend between and are secured to the elastomeric filaments of the elastomeric warp and into the carded layer on the other side of the warp. The anchoring fibers act to increase the strength of the attachment of the staple fibers to the elastomeric filaments, as described in more detail below.

The hydroentangling station 30 is constructed in a conventional manner as known to the skilled artisan and as described, for example, in U.S. Pat. No. 3,485,706 to Evans, which is hereby incorporated by reference. As known to the skilled artisan, fiber hydroentanglement is accomplished by jetting liquid, typically water, from manifolds 32 supplied at a pressure from about 200 psig up to about 1800 psig or greater, to form fine, essentially columnar liquid streams. The high pressure liquid streams are directed to at least one surface of the composite layered structure. The composite is supported on a foraminous support screen 34 which can have a pattern to form a nonwoven structure with a pattern or with apertures, or the screen can be designed and arranged to form a hydraulically entangled composite which is not patterned or apertured. The laminate can be passed through a second hydraulic entangling station to enable hydraulic entanglement on the other side of the composite web fabric.

During the hydroentanglement treatment, the staple fibers and anchoring fibers in carded web layers 8 and 26 are forced between and secured to the elastomeric filaments of elastomeric warp 16. As understood by the skilled artisan, fiber entanglement or interlocking takes place on a fiber-to-fiber scale. Preferably, the hydroentangling treatment is sufficient to force at least a portion of the staple fibers and anchoring fibers in both carded layers 8 and 26 between and secured to the elastomeric filaments in the elastomeric warp 16.

The elastomeric warp remains in a substantially planer arrangement during the hydroentangling treatment. Thus, the longitudinal, i.e. machine direction (MD) strands, of the elastomeric warp 20 undergo little if any movement in the cross-sectional direction, i.e. the Z-direction, within the web. Thus, the elastomeric warp remains in a discrete interior cross-sectional portion of the composite web.

A condensed, hydraulically entangled composite web 36 exits the hydroentanglement station 30, and is dried at a conventional drying station (not shown).

Depending upon the type of anchoring fibers used in the fibrous webs of the composite nonwoven fabric, the composite web 36 can be wound by conventional means onto a storage roll or can be directed into a thermal treatment station and subsequently directed to a roll for storage.

FIG. 1 illustrates one embodiment of the invention in which the anchoring fibers are thermally activated binder fibers. When the anchoring fibers are binder fibers the composite web 36 is treated to thermally activate the binder fibers so as to roughen the surface of the binder fibers. This provides fibers having an irregular surface. This surface irregularity causes increased frictional interaction between the thermally activated binder fibers and the components of the fabrics, and increased mechanical attachment of the binder fibers to the elastic filaments.

The composite web 36 is directed to thermal treatment station 40, illustrated in FIG. 1 as a through-air bonding oven 44. The operating temperature of through-air bonding oven 44 should be adjusted to a surface temperature such that the binder fibers present in the composite web 36 are thermally activated sufficiently to roughen the surface of the binder fibers to mechanically strengthen the attachment to or securement of the staple fibers to the elastomeric filaments. A coherent substantially unitary structure results, having improved durability in use.

The heat transfer conditions are advantageously maintained to avoid thermal degradation or melting of the elastomeric warp 16 which is present within the interior of the composite web 36, therefore avoiding thermal degradation of the elastomer or its stretch and recovery properties. In addition, advantageously, heating conditions are controlled so as to avoid activating adhesion bonding by the binder fibers to the elastomeric filaments and/or the staple fibers, although some degree of thermal binding can result without substantially adversely affecting the mechanical attachment of the components of the elastic composite fabric.

The composite elastic web 46 is removed from through-air oven 44 and wound by conventional means onto roll 48. The composite elastic web 46 can be stored on roll 48 or immediately passed to end use manufacturing processes, for example for use in bandages, diapers, disposable undergarments, personal hygiene products and the like.

Binder fibers are known in the art and include fibers made from low melting polyolefins such as polyethylenes; polyamides and particularly copolyamides; polyesters and particularly copolyesters; acrylics and the like. The binder fibers may have a higher or lower activation temperature than the melting or softening point of the elastomeric filaments. In the case that the binder fibers activate above the glass transition temperature of the thermoplastic elastomer, then heating conditions must be closely controlled to bind the fibers without deforming or degrading the elastomeric warp.

Particularly preferred binder fibers include bicomponent and multi-component fibers such as sheath/core, side-by-side, sectorized or similar bicomponent fibers wherein at least one component of the fiber is a low melting material such as a polyethylene, a copolyester, a copolyamide, and the like. Particularly preferred bicomponent fibers have a melting temperature for the binder portion of the fiber in the range of between about 100° and 135° C. Such fibers include polypropylene/polyethylene and polyester/polyethylene sheath/core fibers and polyester/copolyester sheath/core fibers. One preferred binder fiber is a copolyester/polyester sheath/core fiber having a melting point of about 110° C. commercially available from Hoechst-Celanese Corporation as "K-54". Additional binder fibers useful in the invention include polyethylene/polyester bicomponent fibers available from BASF as Merge 1050 and Merge 1080 . Another preferred binder fiber is a polyethylene-based wood pulp structure available from Hercules, Inc. as Pulpex®.

In other embodiments of the invention, the anchoring fibers are provided as wood fibers, meltblown fibers, flash spun fibers, and the like, all as are known to the skilled artisan. For example, wood fibers may be obtained from well-known chemical processes such as the kraft and sulfite processes, or from mechanical processes. The production of wood fibers is known. Preferred wood fibers have an average fiber length of three to five millimeters and a low coarseness index. Western red cedar, redwood, and northern softwood kraft fibers are particularly useful in the invention. Additional fiber surface area can be provided by wet refining the fibers to decrease their coarseness.

Meltblown fibers and flash spun fibers are also known in the art. Meltblowing processes and apparatus are disclosed in, for example, in U.S. Pat. No. 3,849,241 to Buntin, et al. and U.S. Pat. No. 4,048,364 to Harding, et al. The meltblowing process involves extruding a molten polymeric material through fine capillaries into fine filamentary streams. The filamentary streams exit the meltblowing spinneret head where they encounter converging streams of high velocity heated gas, typically air. The converging streams of high velocity gas attenuate the polymer streams and break the attenuated streams into meltblown fibers.

Flash spun fibers are in the form of a three dimensional network of thin continuous interconnected ribbons, termed film-fibrils or plexifilaments. Plexifilaments are produced by extruding the fiber-forming polymer through a single orifice in a high temperature, high pressure solution in an inert solvent.

As noted above, during hydroentanglement, fiber entanglement occurs, providing bonding by interlocking the fibers with the elastomeric filaments. The addition of anchoring fibers as described above to the fibrous web greatly increases the surface area of the fibrous web and promotes friction between the staple fiber webs and the elastomeric filaments. That is, the anchoring fibers increase the number of loci where frictional contract occurs. Thus the anchoring fibers also act as a mechanical bonding agent by mechanically securing the staple fibers to the elastomeric filaments and strengthening the attachment to or securement of the staple fibers to the elastomeric filaments.

As with the use of binder fibers, the resultant composite fabric formed using anchoring fibers such as meltblown fibers, wood fibers, etc., is a coherent substantially unitary structure encompassing the elastomeric filaments and having increased durability and mechanical stability. In this embodiment, thermal treatment such as that described above with regard to the use of binder anchoring fibers is not required, and the composite nonwoven fabric can be removed from a conventional drying station and directly wound by conventional means onto a storage roll.

The methods described above and illustrated in FIG. 1 are susceptible to numerous preferred variations. For example, although the schematic illustration of FIG. 1 shows carded web being formed directly during the in-line process, it will be apparent that the carded webs can be preformed and supplied as rolls of preformed webs. Such preformed webs are preferably only lightly bonded, so that the force of the hydroentanglement jets can overcome the bonding and cause the staple fibers to be entangled. Similarly, although the elastomeric warp is shown being formed in-line, the elastomeric warp may be supplied as a preformed warp, i.e. as a warp beam on which warp yarns or filaments are wound. Similarly, although FIG. 1 illustrates use of fibrous webs 8 and 26 both above and below the elastomeric warp 16, only a single fibrous web such as web 8 can be employed, or more than two fibrous webs can be employed.

The through-air bonding oven 44 can, in other embodiments of the invention, be replaced by other thermal activation zones, for example in the form of heated calender rolls, or steam cans. Other heating stations such as ultrasonic welding stations can also be advantageously used in the invention. Such conventional heating stations are known to those skilled in the art and are capable of effecting substantial thermal activation of binder fibers when present in the composite web 36.

Nonwoven webs other than carded webs are also advantageously employed in the production of fabrics of the invention. Nonwoven staple webs can be formed by air laying, garnetting, wet laying and similar processes known in the art. For example, wet laid webs comprising polyester staple fibers and 10–50% by weight wood fibers as described above can be used. Also, tissue paper formed of 100% wood pulp fibers, creped to increase the surface area thereof, may be used. In addition, other webs can be used in combination with one or more carded webs, such as spunbonded webs and meltblown webs.

Figure 2:
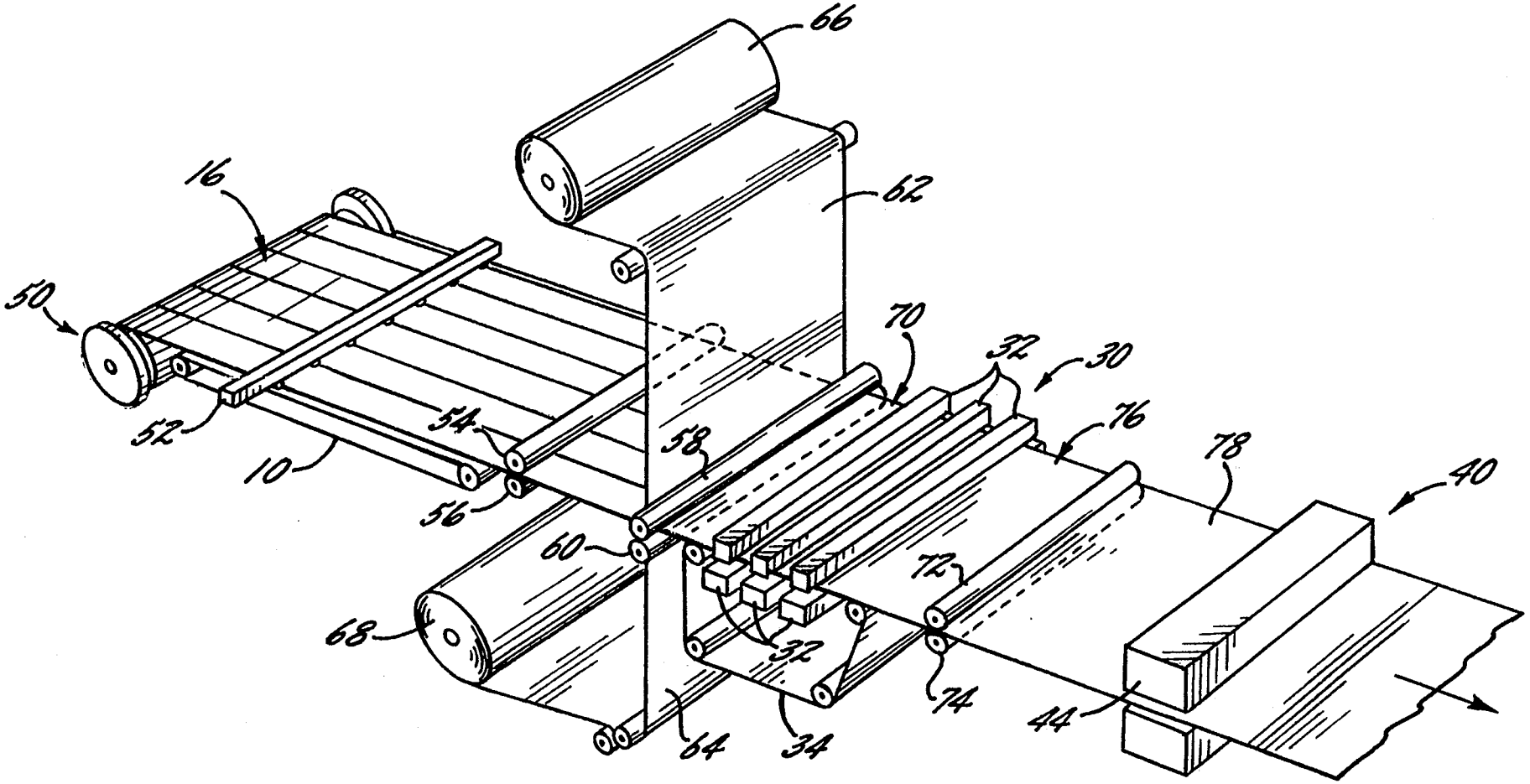
FIG. 2 schematically illustrates another method and apparatus for the manufacture of a composite elastic nonwoven fabric according to the invention.

FIG. 2 illustrates a process of the invention wherein elastomeric warp 16 is provided as a preformed warp supplied by a warp beam 50. As known in the art, a warp beam is a cylinder on which warp yarns or filaments are wound. The warp beam is attached to shafts which turn to unwind the warp filaments parallel to one another to form a warp sheet. Advantageously, guide bar 52 is provided through which the ends of the filaments of the warp are threaded.

The elastomeric filaments can be stretched in the machine direction (MD) thereof during hydroentanglement of the composite fabric. Elastomeric warp 16 is deposited onto a screen 10 and fed via a pair of feed rolls 54, 56 to a pair of stretching rolls 58 and 60 to stretch the warp in the MD direction.

Two preformed webs 62 and 64 are fed via supply rolls 66 and 68, respectively, to the feed rolls 58 and 60 for layering with the warp 16 while it is in the stretched condition. One or both of webs 62 and 64 includes anchoring fibers, preferably in an amount of about 10 to 50 percent by weight of the fibrous web. It is also preferred that at least one of webs 62 and 64 is a staple fiber web which can be preformed via air laying, garnetting or carding. In addition, one of the webs 62 and 64 can constitute a meltblown web or a web of unbonded continuous filaments.

The combined 3-layer structure 70 is passed through hydroentangling station 30 while the warp 16 is maintained in a stretched condition by down-stream rollers 72 and 74. High pressure water jets from manifolds 32 force fibers from the fibrous webs 62 and 64 around the filaments of the stretched elastic warp 16 during passage through the hydroentangling station.

The hydroentangled and consolidated structure 76 issuing from the hydroentangling station 30 is thereafter allowed to relax and is then dried by conventional means such as an oven. When the anchoring fibers are binder fibers, as described above, the composite web 78 is passed through a thermal bonding station 40 comprising a through air bonding oven 44 for thermal activation of the thermal binder fibers in the consolidated web 78. As shown in FIG. 2, the thermal treatment of the consolidated web 78 is advantageously conducted while the elastomeric warp 16 is in a relaxed condition. In some cases, thermal treatment can be conducted while the warp is maintained in a stretched condition. Care should be taken that the properties of the elastic filaments are not diminished by such a treatment. If the anchoring fibers are not binder fibers, then thermal treatment is not required and the composite web 78 can be directly passed to storage or to additional manufacturing processes.

As with the process illustrated in FIG. 1, the process illustrated in FIG. 2 is susceptible to numerous variations. Thus, the thermal treating station 40 can comprise any of the previously described thermal treating stations. Likewise, the fibrous webs 62 and 64 can be formed in-line where desirable. Additionally although two fibrous webs 62 and 64 are shown in FIG. 2, only one, or more than two fibrous webs can be combined with the stretched warp 16 during the hydroentanglement.

Figure 3:
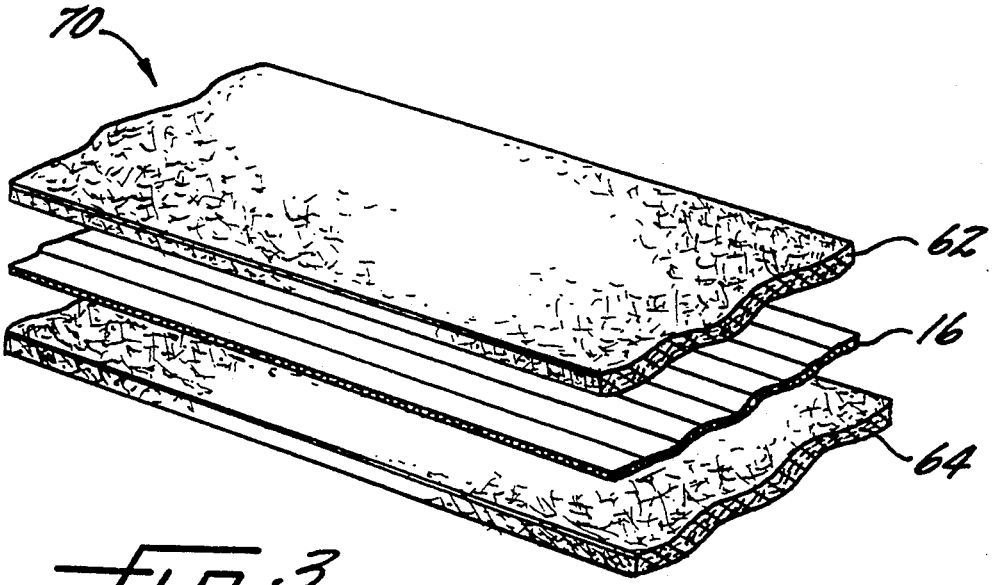
FIG. 3 illustrates a fragmentary exploded view of intermediate layered structure employed in the production of elastic nonwoven fabrics according to the invention.

FIG. 3 illustrates an exploded view of the three layered structure 70 of FIG. 2 prior to hydroentanglement. At least one of the carded web layers 62 and 64 comprises staple fibers such as fibers formed from polyester, polyolefins such as polypropylene or polyethylene, nylon, acrylic, modacrylic, rayon, cellulose acetate, biodegradable synthetics such as a biodegradable polyester, aramide, fluorocarbon, polyphenylene sulfide staple fibers and the like. Natural staple fibers such as wool, cotton, wood pulp fibers and the like can also be present. Blends of such fibers can also be used.

In addition, at least one of the carded webs includes anchoring fibers in an amount from about 10 to 50 percent by weight, and preferably about 20 to 40 percent by weight. When binder fibers are used, the content of the binder fiber is adjusted to provide coherency to the overall combined web without adding an undesirably stiff or boardy feeling to the web. The specific content of the binder fiber will be dependent, at least to some extent, on the type of binder fiber used and on the type of staple fiber used.

The elastic warp 16 includes an elastic material comprising longitudinal, i.e. machine direction, strands or filaments. Suitable elastomers include the diblock and triblock copolymers based on polystyrene (S) and unsaturated or fully hydrogenated rubber blocks. The rubber blocks can consist of butadiene (B), isoprene (I), or the hydrogenated version, ethylene-butylene (EB). Thus, S-B, S-I, S-EB, as well as S-B-S, S-I-S, and S-EB-S block copolymers can be used. Preferred elastomers of this type include the KRATON polymers sold by Shell Chemical Company or the VECTOR polymers sold by DEXCO. Other elastomeric thermoplastic polymers include polyurethane elastomeric materials such as ESTANE sold by B. F. Goodrich Company and LYCRA sold by E. I. Du Pont De Nemours Company; polyester elastomers such as HYTREL sold by E. I. Du Pont De Nemours Company; polyetherester elastomeric materials such as ARNITEL sold by Akzo Plastics; polyetheramide elastomeric materials such as PEBAX sold by ATO Chemie Company; Incite linear low density polyethylene elastomers sold by Dow; and Exact linear low density polyethylene elastomers sold by Exxon.

The elastic filaments in the elastomeric warp 16 can also be prepared from blends of thermoplastic elastomers with other polymers such as polyolefin polymers, e.g. blends of KRATON polymers with. polyolefins such as polypropylene and polyethylene, and the like. These polymers can provide lubrication and decrease melt viscosity, allow for lower melt pressures and temperatures and/or increase throughput, and provide better bonding properties too. In a particularly preferred embodiment of the invention, polymers can be included in the blend as a minor component, for example in an amount of from about 5% by weight up to about 50% by weight, preferably from about 10 to about 30% by weight. Suitable thermoplastic materials include poly-(ethylene-vinyl acetate) polymers having an ethylene content of up to about 50% by weight, preferably between about 15 and about 30% by weight, and copolymers of ethylene and acrylic acid or esters thereof, such as poly(ethylene-methyl acrylate) or poly(ethylene-ethyl acrylate) wherein the acrylic acid or ester component ranges from about 5 to about 50% by weight, preferably from about 15 to 30% by weight.

Generally, the elastomeric warps used in the invention will have a basis weight ranging from about 5 to about 200 grams per square meter, more preferably from about 10 to about 150 grams per square meter and can employ filaments having diameters ranging from 20 to 200 microns.

As indicated previously, the fabrics of the invention can also incorporate webs of substantially continuous filaments, including polyolefin, nylon, polyester, copolymers of the same and other such webs as are known to those skilled in the art. Meltblown nonwovens including both elastomeric and nonelastomeric meltblown webs prepared from polyolefins, nylon, polyesters, random and block copolymers, elastomers and the like are also employed in fabrics of the invention.

Figure 4:
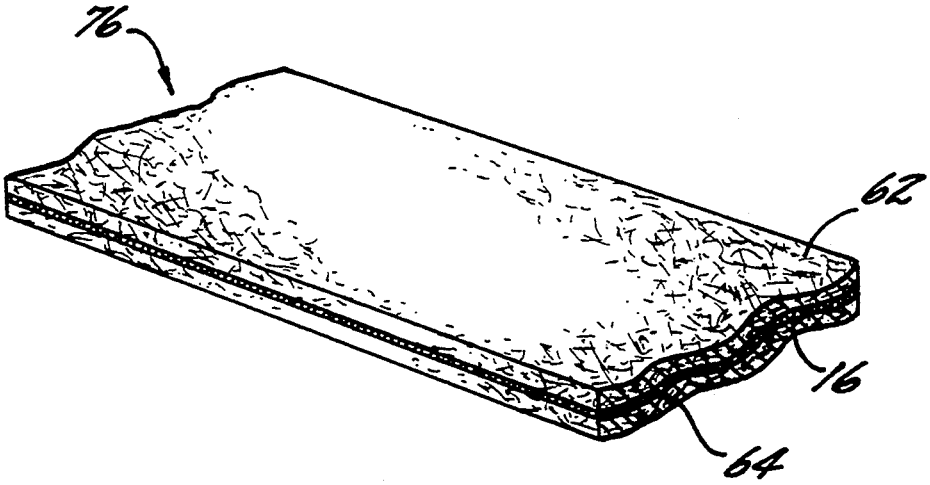
FIG. 4 illustrates a fragmentary perspective view of a composite fabric of the invention showing the exterior fibrous surface of the fabric and the interior elastomeric filaments which have been integrated with the fibrous webs shown.
Figure 5A:
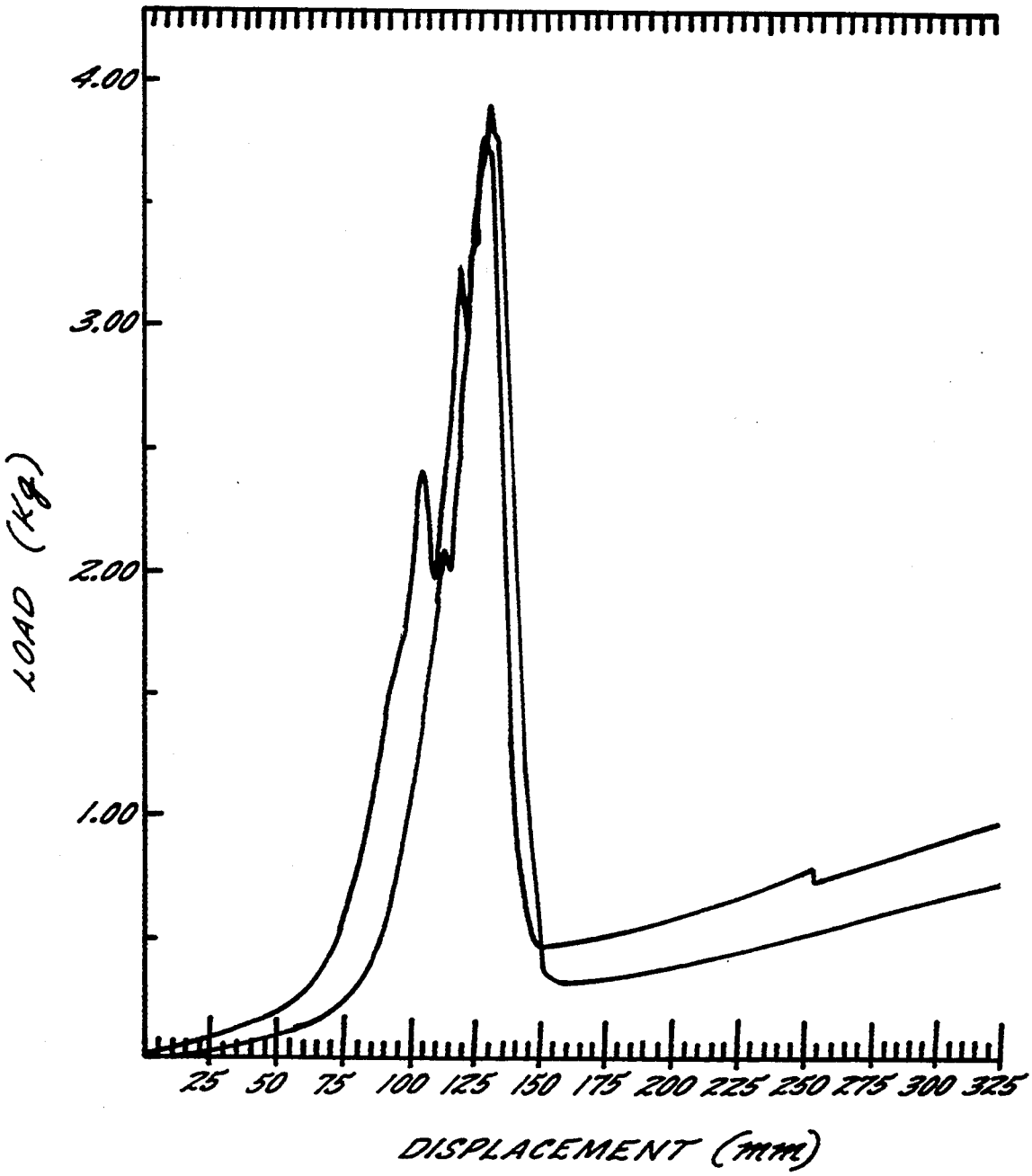
FIGS. 5A, 5B, 5C, and 5D are stress-strain curves exhibited by fabrics of the present invention and comparative fabrics.
Figure 5B:
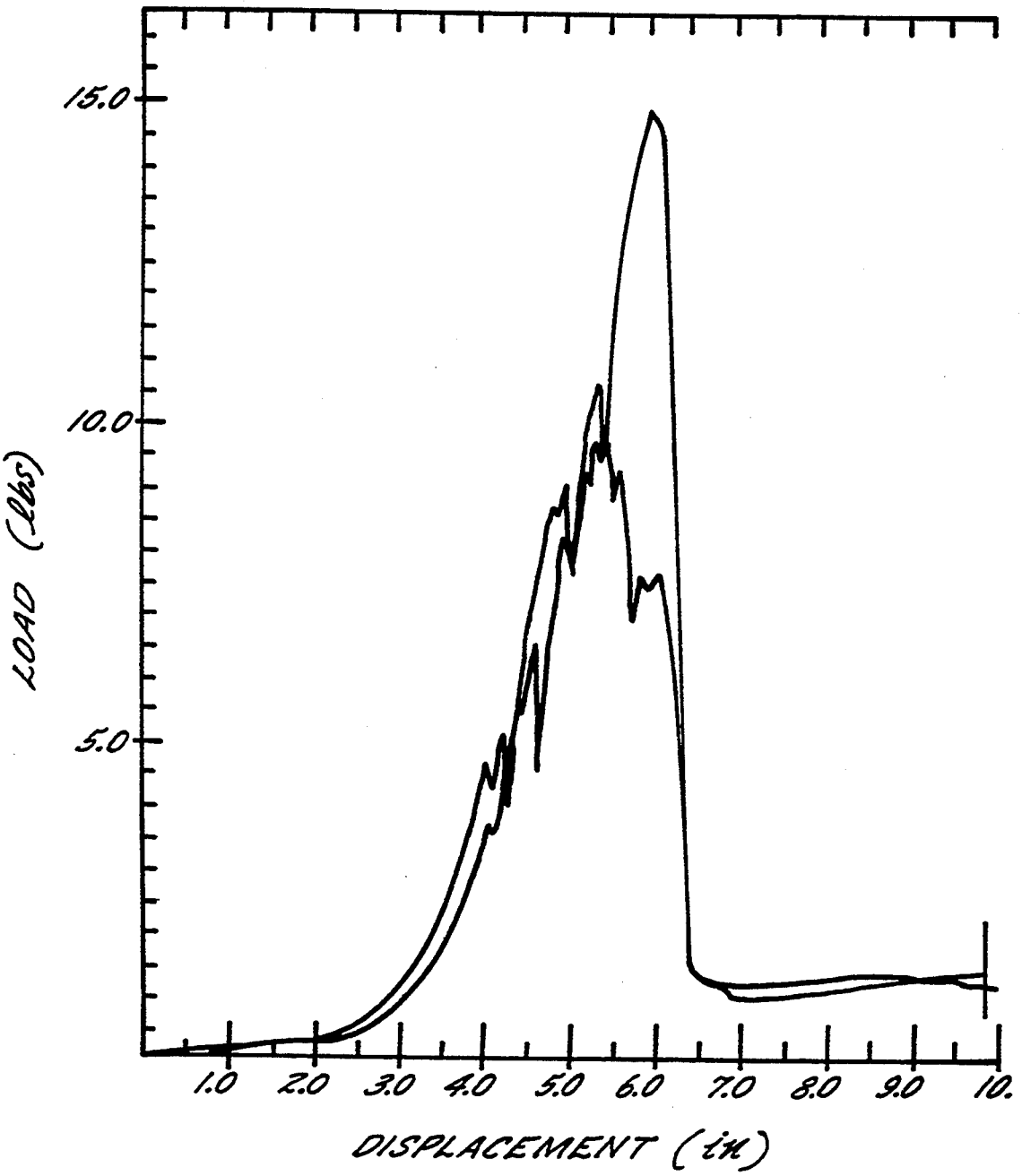
Figure 5C:
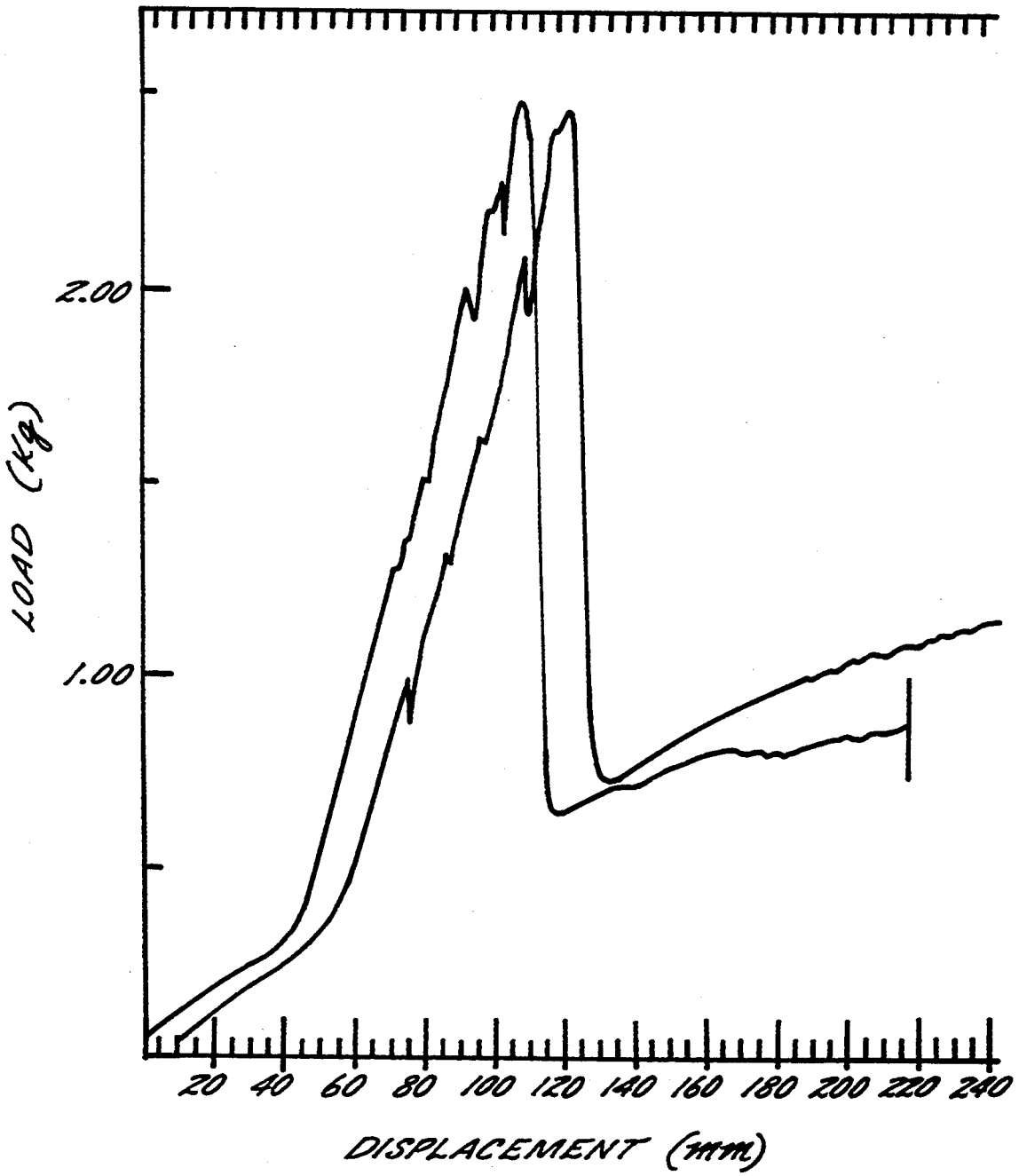
Figure 5D:
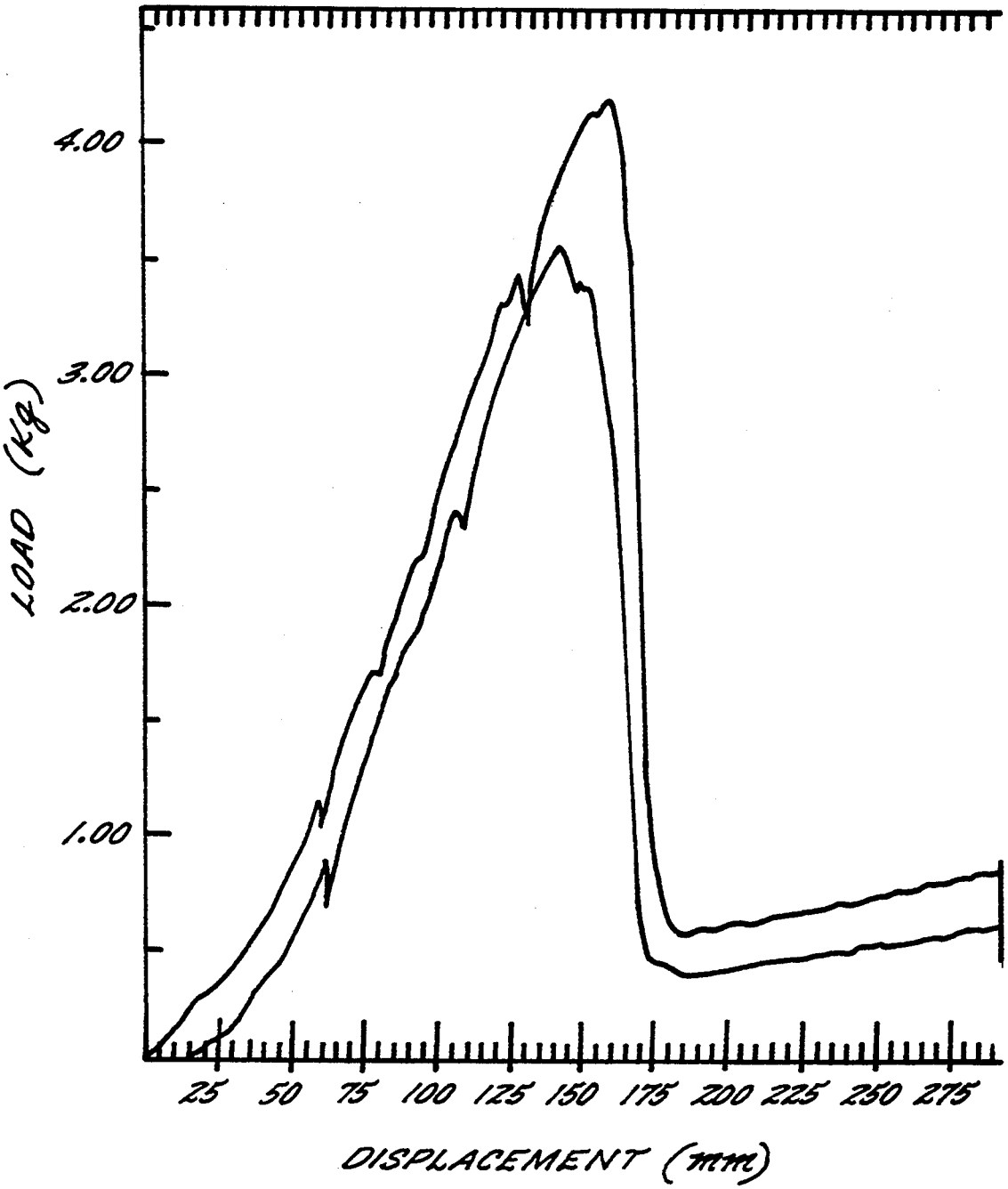

FIG. 4 illustrates a fragmentary perspective view of a fabric according to the invention. As illustrated in FIG. 4, the elastomeric warp is fully encompassed within the fibrous portion of the composite web. The fibers of the fibrous portion of the web extend between and are secured to the elastomeric filaments of the warp and thus the fabric is a unitary coherent fabric. Because the anchoring fibers increase the strength of securement or attachment of the staple fibers in the fibrous web to the elastomeric filaments, the fabric stretches in a uniform manner and is not prone to separation of the elastic filaments from the non-elastic fiber mass.

The following examples are provided to illustrate the fabrics of the invention and processes for making them but are not to be construed as limitations on the invention. In all examples set forth below a polyurethane spandex elastomer, labeled as Comfolastic OA220, sold under the trade name LYCRA by E. I. Du Pont De Nemours Company, was used as the elastomer in the elastomeric filaments of the elastic web.

Example A

A web of carded polyester fibers available from Hoechst-Celanese under the designation T-183 (1.5 denier×1.5″) and weighing approximately 25 grams per square meter (gsm) was placed upon a 13×20 screen of polyester monofilaments. A warp of elastic yarns was prepared by placing lengths of 140 denier T-126 Lycra yarn side by side approximately 0.25″ apart. This warp was stretched 70% and placed on top of the polyester card web. A second polyester card web weighing 25 gsm was placed on top of the stretched elastic filaments.

The layered sample was passed under a hydroentangling manifold a number of times at a speed of 240 feet per minute. The manifold was equipped with 40 orifices per inch of 0.005″ diameter. For the first two passes, the pressure was 400 psi. During the next six passes the pressure was 800 psi. The sample was turned over so that the part of the composite which faced the screen of polyester monofilaments now faced up toward the hydroentanglement manifold. The sample was maintained in the stretched condition and was passed underneath the manifold two additional times at a speed of 240 feet per minute and a manifold pressure of 400 psi. The water pressure was raised to 800 psi and the sample was passed under the manifold four additional times. The sample was removed and allowed to air dry in the relaxed state.

Example B

A web of carded T-183 Hoechst-Celanese polyester (1.5d×1.5″) weighing approximately 25 gsm was placed upon a 13×20 screen of polyester monofilaments. A web of meltblown microfibers prepared from polybutylene terephthalate and weighing approximately 15 gsm was placed on top of the card web. A warp of 140 denier Lycra similar to that in Example A was stretched 70% and placed on top of the first two webs. A second polyester card web weighing 25 gsm was placed on top of the stretched elastic filaments. The layered sample was passed under the hydroentanglement manifold at 240 feet per minute in the following manner: two passes at 400 psi, four passes at 800 psi, and four passes at 1200 psi. The sample was turned over and stretched 70%. It was passed under the hydroentanglement manifold in the following manner: two passes at 400 psi, four passes at 1000 psi. The sample was removed from the forming screen and allowed to air dry in the relaxed state.

Example C

A sample of wet laid nonwoven of basis weight 33 gsm and containing 40% polyester staple (1.5d×0.75") and 60% northern softwood kraft fibers was placed on a 13×20 screen woven from polyester monofilaments. A warp of stretched Lycra filaments similar to those used for examples A and B was placed on top of the wet laid nonwoven. A second layer of wet laid nonwoven identical to the first was placed on top of the stretched elastic warp. The layered sample was then hydroentangled according to the following sequence: top side-two passes at 400 psi, four passes at 800 psi, four passes at 1000 psi. The sample was turned over, stretched 70%, and hydroentangled at 240 feet per minute at the following conditions: two passes at 400 psi followed by one pass at 1000 psi.

Example D

A web of carded BASF T-1050 polyethylene-polyester bicomponent staple fiber (3.0d×1.5") weighing approximately 25 gsm was placed upon a 13×20 screen of polyester monofilaments. A warp of stretched Lycra elastic yarns similar to those used for Examples A, B, and C was placed on top of the stretched elastic warp. The layered sample was then hydroentangled at 240 feet per minute according to the following sequence: two passes at 400 psi, four passes at 800 psi, and two passes at 1000 psi. The sample was turned over, stretched 70%, and hydroentangled at 240 feet per minute at the following conditions: two passes at 400 psi, two passes at 800 psi. The sample was passed through a through air oven in a stretched state. The oven was set at 130° C. The dwelling time in the oven was approximately 5 seconds.

The deterioration of the mechanical properties of these examples was measured by the following series of tests:

Two 1"×4" specimens were cut from each example. These specimens were placed in an Instron tensile tester and elongated to 150%. The retractive force for each sample is set forth below in Table I.

Two 3"×5" specimens were cut from examples A through D. These specimens were placed under the motor driven arm of a TMI Model 32-06 Slip Friction Tester, which weighs 200 g. A piece of cotton t-shirt fabric was placed on the flat surface of the friction tester, beneath the test specimens. Each specimen was pulled for 6 inches across the t-shirt fabric at a speed of 11 cm/min. Sample A lost much of its elastic crimp during this test.

Two 1"×4" specimens were cut from the elastic fabric samples which had undergone the friction test. These samples were placed in an Instron tensile tester and extended 150%. The retractive force at this extension is recorded in Table I. It is clear that Example A suffered considerable degradation in its mechanical properties during the friction test. The detachment of the elastic filaments from the staple fibers in Example A was clearly evident. No such deterioration occurred in Examples B through D.

TABLE I

RETRACTIVE FORCE OF ELASTIC WRAP NONWOVEN COMPOSITES

| | Before Friction Test | After Friction Test |
|---|---|---|
| Example A | 8.6 ± 2.0 | 3.85 ± 0.6 |
| Example B | 6.35 ± 0.15 | 5.9 ± 2.2 |
| Example C | 10.7 ± 3.3 | 10.4 ± 0.4 |
| Example D | 14.1 ± 2.0 | 14.2 ± 0.8 |

The mechanism of operation of these fabrics is illustrated by the stress-strain curves obtained in the Instron tensile tester, shown in FIGS. 5A through 5D. The fabric elongates until an extension of approximately 250% is reached. The staple fiber network breaks, but the elastic filaments remain intact and continue elongating along a path with a much lower modulus of elasticity.

Although not wishing to be bound by any theory or explanation of the present invention, it is currently believed that the friction between the elastic filaments and the other fibers is an important factor in providing the properties of the fabrics of the invention. This was evidenced when the dimensionally stable fabric, a composite made with heat activated bicomponent fibers, was examined under a microscope. The bicomponent fibers do not bond to the elastic filaments. When heated, the polyethylene on the surface of the bicomponent fibers becomes very irregular. This surface irregularity causes increased mechanical attachment of the bicomponent fibers to the elastic filaments. When the filaments are stretched, the bonded mass of bicomponent fibers moves with them.

The mechanism of operation for composites containing wood fibers is similar. The wood fibers have an irregular surface which promotes mechanical attachment to the elastic filaments.

The mechanism by which meltblown fibers promote attachment to the elastic is somewhat different than the case of the wood fibers or the activated bicomponent fibers. The meltblown fibers have greater friction per unit weight than ordinary staple fibers because of their greater numbers. The diameter of a typical meltblown microfiber is 5 microns. This compares with a diameter of 18 microns for a typical staple fiber of 1.5 denier. In a gram of meltblown microfibers, there are approximately 120 times the length of fiber and four times the surface area as in a gram of textile staple fibers. This gives the meltblown web a higher frictional component in its interaction with other fibers.

That which is claimed is:

1. A composite elastic nonwoven fabric comprising:

a warp of individual elastomeric filaments oriented substantially parallel to one another extending longitudinally in the machine direction; and a fibrous web entangled with said warp of individual elastomeric filaments to form a unitary elastic nonwoven fabric, said fibrous web comprising staple fibers and anchoring fibers, said anchoring fibers being secured to said elastomeric filaments throughout the fabric to keep the fibrous web attached to the filaments upon stretching and recovery of the elastomeric filaments and to thereby maintain the coherent substantially unitary structure of the composite elastic nonwoven fabric.

2. The composite nonwoven fabric according to claim 1 wherein said warp and said fibrous web are hydroentangled.

3. The composite nonwoven fabric according to claim 1 wherein said anchoring fibers are of a different composition than said staple fibers.

4. The composite nonwoven fabric according to claim 1 wherein said fibrous web comprises anchoring fibers in an amount of about 10 to 50 percent by weight of the fibrous web.

5. The composite elastic nonwoven fabric according to claim 1 wherein said anchoring fibers are fibers mechanically secured to said staple fibers and to said elastomeric filaments.

6. The composite elastic nonwoven fabric according to claim 5 wherein said anchoring fibers are selected from the group consisting of wood pulp fibers, meltblown thermoplastic fibers, and thermally activated binder fibers.

7. The composite nonwoven fabric according to claim 6 wherein said binder fibers are bicomponent fibers.

8. The composite nonwoven fabric according to claim 6 wherein said binder fibers comprise polyethylene.

9. The composite nonwoven fabric according to claim 6 wherein said binder fibers are thermally activated by through air bonding.

10. The composite nonwoven fabric according to claim 1 wherein said fibrous web is a carded web.

11. The composite nonwoven fabric according to claim 1 wherein said staple fibers are selected from the group consisting of polyester, polyolefin, nylon, and acrylic fibers.

12. The composite nonwoven web according to claim 1 wherein said elastomeric filaments are maintained in a stretched condition during entangling of said elastomeric filaments and said fibrous web.

13. The composite nonwoven fabric according to claim 1 further comprising a web of substantially continuous filaments entangled with said elastomeric filaments and said fibrous web.

14. The composite nonwoven fabric according to claim 1 further comprising a meltblown web entangled with said elastomeric filaments and said fibrous web.

15. The composite nonwoven fabric according to claim 1 further comprising a carded web entangled with said elastomeric filaments and said fibrous web.

16. A composite elastic nonwoven fabric comprising:

a warp of individual elastomeric filaments oriented substantially parallel to one another extending longitudinally in the machine direction; and a fibrous web entangled with said warp of individual elastomeric filaments to form a unitary elastic nonwoven fabric, said fibrous web comprising staple fibers and anchoring fibers selected from the group consisting of wood pulp fibers, meltblown thermoplastic fibers, and thermally activated binder fibers, said anchoring fibers being mechanically secured to said elastomeric filaments throughout the fabric to keep the fibrous web attached to the filaments upon stretching and recovery of the elastomeric filaments and to thereby maintain the coherent substantially unitary structure of the composite elastic nonwoven fabric.

17. The composite nonwoven fabric according to claim 16 wherein said elastomeric filaments and said fibrous web are hydroentangled.

18. The composite nonwoven web according to claim 16 wherein said elastomeric filaments are maintained in a stretched condition during entangling of said elastomeric filaments and said fibrous web.

19. A process for producing a composite elastomeric nonwoven fabric comprising:

forming a layered structure comprising a warp of individual elastomeric filaments oriented substantially parallel to one another in the machine direction and a fibrous web comprising staple fibers and anchoring fibers; and entangling said warp of individual elastomeric filaments and said fibrous web to form a unitary elastic nonwoven fabric, said anchoring fibers being secured to said elastomeric filaments throughout the fabric to keep the fibrous web attached to the filaments upon stretching and recovery of the elastomeric filaments and to thereby maintain the coherent substantially unitary structure of the composite elastic nonwoven fabric.

20. The process according to claim 19 wherein said entangling step comprises hydroentangling said elastomeric filaments and said fibrous web.

21. The process according to claim 19 wherein said fibrous web comprises anchoring fibers in an amount of about 10 to 50 percent by weight of said fibrous web.

22. The process according to claim 19 wherein said anchoring fibers are fibers mechanically secured to said staple fibers and said elastomeric filaments.

23. The process according to claim 22 wherein said anchoring fibers are selected from the group consisting of wood pulp fibers, meltblown thermoplastic fibers, and thermally activated binder fibers.

24. The process according to claim 23 wherein said binder fibers are bicomponent fibers.

25. The process according to claim 24 wherein said binder fibers comprise polyethylene.

26. The process according to claim 23 wherein said binder fibers are thermally activated by through air bonding.

27. The process according to claim 19 wherein said fibrous web is a carded web.

28. The process according to claim 19 wherein said staple fibers are selected from the group consisting of polyester, polyolefin, nylon, and acrylic fibers.

29. The process according to claim 19 further comprising the steps of:

stretching said elastomeric filaments in the longitudinal direction prior to said entangling step; and maintaining said elastomeric filaments in said stretched condition during said entangling step.

30. A process for producing a composite elastomeric nonwoven fabric comprising the steps:

stretching in the longitudinal direction a warp of individual elastomeric filaments oriented substantially parallel to one another;

forming a layered structure comprising said warp of individual elastomeric filaments and a fibrous web comprising staple fibers and anchoring fibers selected from the group consisting of wood pulp fibers, meltblown thermoplastic fibers, and thermally activated binder fibers; and entangling said warp of individual elastomeric filaments and said fibrous web to form a unitary elastic nonwoven fabric, said anchoring fibers being mechanically secured to said elastomeric filaments throughout the fabric to keep the fibrous web attached to the filaments upon stretching and recovery of the elastomeric filaments and to thereby maintain the coherent substantially unitary structure of the composite elastic nonwoven fabric.

31. The process of claim 30 further comprising the step of maintaining said elastomeric filaments in said stretched condition during said entangling step.

* * * * *